US011077493B2

(12) United States Patent
Olejnik et al.

(10) Patent No.: US 11,077,493 B2
(45) Date of Patent: Aug. 3, 2021

(54) POWDER COMPOSITION FOR THE MANUFACTURE OF CASTING INSERTS, CASTING INSERT AND METHOD OF OBTAINING LOCAL COMPOSITE ZONES IN CASTINGS

(71) Applicant: Innerco Sp. Z O.O., Cracow (PL)

(72) Inventors: Ewa Olejnik, Skala (PL); Anna Jesiolowska, Cracow (PL)

(73) Assignee: Innerco sp. Z o.o., Cracow (PL)

( * ) Notice: Subject to any disclaimer, the term of this patent is extended or adjusted under 35 U.S.C. 154(b) by 237 days.

(21) Appl. No.: 15/775,142

(22) PCT Filed: Nov. 11, 2016

(86) PCT No.: PCT/IB2016/056825
§ 371 (c)(1),
(2) Date: May 10, 2018

(87) PCT Pub. No.: WO2017/081665
PCT Pub. Date: May 18, 2017

(65) Prior Publication Data

US 2018/0369905 A1 Dec. 27, 2018

(30) Foreign Application Priority Data

Nov. 12, 2015 (PL) ..... 414755
Nov. 11, 2016 (PL) ..... 419422

(51) Int. Cl.
*B22D 19/02* (2006.01)
*B22F 7/06* (2006.01)
(Continued)

(52) U.S. Cl.
CPC ..... *B22D 19/02* (2013.01); *B22F 7/062* (2013.01); *C22C 1/02* (2013.01); *C22C 1/05* (2013.01);
(Continued)

(58) Field of Classification Search
CPC ..... B22D 19/02; B22D 19/14; B22F 2302/05; B22F 2302/10; B22F 1/0011; B22F 3/02;
(Continued)

(56) References Cited

U.S. PATENT DOCUMENTS

2007/0090169 A1 4/2007 Poncin et al.
2011/0303778 A1 12/2011 Berton
2015/0290706 A1 10/2015 Andreussi et al.

FOREIGN PATENT DOCUMENTS

CN 1868635 A 11/2006
CN 101214541 A 7/2008
(Continued)

*Primary Examiner* — Kevin P Kerns
(74) *Attorney, Agent, or Firm* — GableGotwals

(57) ABSTRACT

A powder composition is used for the fabrication of casting inserts designed to produce local composite zones resistant to abrasive wear. The composite zones are reinforced with carbides and borides or with mixtures thereof formed in situ in castings. The powder includes powder reactants of the formation of carbides and/or borides selected from the group of TiC, WC, ZrC, NbC, TaC, TiB2, ZrB2, or mixtures thereof. The carbides and/or borides forming after crystallization particles reinforces the composite zones in castings. The powder composition further includes moderator powders in the form of a mixture of metal powders, which after crystallization form matrix of the composite zone in casting. A casting insert is disclosed for the fabrication in casting of local composite zones resistant to abrasive wear. A method for the fabrication of local composite zones in castings uses for this purpose the reaction of the self-propagating high temperature synthesis (SHS).

9 Claims, 13 Drawing Sheets

(51) Int. Cl.

| | |
|---|---|
| ***C22C 1/02*** | (2006.01) |
| ***C22C 1/05*** | (2006.01) |
| ***C22C 38/18*** | (2006.01) |
| ***C22C 37/08*** | (2006.01) |
| ***C22C 37/10*** | (2006.01) |
| ***C22C 38/02*** | (2006.01) |
| ***C22C 38/04*** | (2006.01) |
| *B22F 1/00* | (2006.01) |

(52) U.S. Cl.
CPC ..... *C22C 1/055* (2013.01); *C22C 1/058* (2013.01); *C22C 37/08* (2013.01); *C22C 37/10* (2013.01); *C22C 38/02* (2013.01); *C22C 38/04* (2013.01); *C22C 38/18* (2013.01); *B22F 1/0011* (2013.01); *B22F 2301/35* (2013.01); *B22F 2302/10* (2013.01); *B22F 2998/10* (2013.01); *B22F 2999/00* (2013.01); *C22C 1/053* (2013.01)

(58) Field of Classification Search
CPC .. B22F 3/1039; B22F 3/23; B22F 7/06; B22F 7/062; C22C 1/05; C22C 1/051; C22C 1/053; C22C 1/055; C22C 1/058
USPC ..... 164/54, 91, 332
See application file for complete search history.

(56) References Cited

FOREIGN PATENT DOCUMENTS

| | | |
|---|---|---|
| JP | 2005511310 A | 4/2005 |
| JP | 2012502802 A | 2/2010 |

0 10 30 50 60 70 80 90 97

Moderator addition, wt%

0 10 30 50 60 70 80 90 97

Moderator addition, wt%

POWDER COMPOSITION FOR THE MANUFACTURE OF CASTING INSERTS, CASTING INSERT AND METHOD OF OBTAINING LOCAL COMPOSITE ZONES IN CASTINGS

CROSS-REFERENCE TO RELATED APPLICATIONS

This United States application is the National Phase of PCT Application No. PCT/IB2016/056825 filed 11 Nov. 2016, which claims priority to Polish Patent Application Nos. P. 414755 filed 12 Nov. 2015 and P. 419422 filed 11 Nov. 2016, each of which is incorporated herein by reference.

STATEMENT REGARDING FEDERALLY SPONSORED RESEARCH

Not Applicable

NAMES OF THE PARTIES TO A JOINT RESEARCH AGREEMENT

Not Applicable

REFERENCE TO SEQUENCE LISTING Not Applicable

BACKGROUND OF THE INVENTION

The object of the present invention is powder composition for the manufacture of casting inserts used in the fabrication of wear-resistant local composite zones; another object of the present invention is casting insert, the use of which allows increasing the resistance to abrasive wear in cast parts of machines operating under conditions of heavy mechanical loads. The present invention also provides a method for the fabrication of local composite zones in castings, wherein said local composite zones increase the resistance of castings to the degradation process and the resistance to abrasive wear of machinery operating under conditions of heavy mechanical loads.

In the technology of making castings, which in selected areas are characterized by increased resistance to shock and abrasion, the process of in situ synthesis of the silicon carbide SiC uses the method of Self-Propagating High Temperature Synthesis (SHS). The process of the synthesis of titanium carbide TiC is well known in the field of classical powder metallurgy. Equally well known are the problems concerning the control of the SHS reaction, wherein said reaction once initiated is a self-sustained process, which means that the amount of heat generated by the reaction can further spread out this reaction. Fading of the reaction can occur only then, when the heat volume dissipated by the system is larger than the heat volume generated during the reaction.

As regards casting processes, well-known is the method disclosed in U.S. Patent US2011/0226882A1, by means of which local composite reinforcements are fabricated in the cast parts of machines and equipment. The disclosed method involves placing in mould cavity the shaped inserts or granules of reactants responsible for the formation of titanium carbide TiC, which are next poured with molten iron-based alloy. The heat supplied by molten alloy initiates the reaction of the synthesis of titanium carbide TiC. The in situ process of the synthesis taking place in molten alloy is governed by the physical phenomena occurring in liquids. This applies, in particular, to the reactive infiltration assisted by capillary phenomena, intensified by a high temperature of the alloy cast and by a high value of the heat generated during the reaction of the synthesis of titanium carbide TiC. After initiation of the reaction of synthesis, the crystals of titanium carbide TiC nucleating and growing in molten alloy can build bridges and undergo coalescence. However, said reactive infiltration results in spreading of molten alloy between the nucleating and growing crystals or coagulated particles of TiC. As a consequence, particles or crystals of titanium carbide TiC are separated by the liquid. Since the crystals or particles of titanium carbide TiC are exposed to the effect of the force of buoyancy caused by different densities of the molten iron-based alloy and titanium carbide, the result is an uneven distribution of said elements in casting. This can lead to fragmentation of the composite zone, which is an obstacle to the formation of an effective local composite reinforcement in the casting. Particularly undesirable in castings is the devastating effect of crack propagation. Cracks in the cast material are initiated by microcracks, which can occur in those areas of the casting where the most brittle phase of the material is located, said phase being in this case composed of the particles of titanium carbide TiC. It is therefore advantageous and desirable that the brittle areas composed of titanium carbide TiC were thoroughly separated from each other by a metallic matrix material, since any larger amount of the metallic matrix material present between the particles of titanium carbide TiC will arrest further propagation of these brittle areas.

U.S. Patent US 20110303778A1 discloses a process which reduces the phenomenon of crack propagation. The aim has been achieved through the use of material characterized by a hierarchical structure, wherein the reinforced phase comprises, spread in a ferrous alloy, millimetric granules containing micrometric coagulated particles of titanium carbide TiC, and wherein the areas between the particles of titanium carbide TiC are also filled with a ferrous alloy. In order to achieve the structure shown, previously prepared granules of compressed powders of Ti and C are placed in selected areas of casting mould, and are prevented from being dispersed by separating means, and then the mould is poured with a ferrous alloy. The granulated composite structure allows controlling the size of the areas with clusters of titanium carbide TiC and partial control of the distance between these clusters. Additionally, it also facilitates the removal of gases formed during the SHS synthesis, which reduces the number of pores in casting. On the other hand, the granular structure does not provide sufficient resistance of the material to abrasive wear. Large distances between the granules with particles of titanium carbide TiC are not preferred, since they facilitate the erosion process in the infiltrating material, and this, in turn, promotes chipping of the agglomerates of titanium carbide TiC. Hence the target is to develop a composite structure that will resist the effect of crack propagation and also the effect of erosion.

BRIEF SUMMARY OF THE INVENTION

In the manufacture of modern parts of machines and equipment made by the technique of casting, the target is to seek new simplified methods for the fabrication of local zones of increased strength and resistance to abrasive wear, thus improving further the durability of cast parts of said machines and equipment, allowing simultaneously for a convenient and easy application of these methods without the need to use any additional devices. The essence of the present invention is a powder composition for the fabrication of casting inserts designed to produce local composite zones resistant to abrasive wear, wherein said composite zones are reinforced with carbides and borides formed in situ in castings, and wherein said powder composition is characterized in that it comprises powder reactants of the formation of carbides and/or borides selected from the group of TiC, WC, ZrC, NbC, TaC, $TiB_2$, $ZrB_2$, or mixtures thereof, said carbides and/or borides forming after crystallization particles reinforcing the composite zones in castings, and wherein said powder composition further comprises moderator powders in the form of a mixture of metal powders which after crystallization form matrix of the composite zone in casting.

Preferably, the amount of powder reactants of the titanium carbide TiC formation in the composition according to the invention is from 3 to 40 wt % and the amount of moderator powders is from 60 to 97 wt %.

Also preferably, the amount of powder reactants of the tungsten carbide WC formation in the composition according to the invention is from 40 to 99 wt % and the amount of moderator powders is from 1 to 60 wt %.

Also preferably, the amount of the mixture of powder reactants of the coupled reaction of the formation of titanium carbide TiC and tungsten carbide WC in the composition according to the invention is from 10 to 70 wt % and the amount of moderator powders is from 30 to 90 wt %.

Also preferably, the powder reactants of the formation of carbides and/or borides have particles of the size of up to 100 μm, but preferably not larger than 45 μm.

Preferably, the moderator powders additionally comprise a non-metal in the form of C.

Preferably, carbon as a reactant powder takes the form of graphite, amorphous graphite, a carbonaceous material or mixtures thereof, and in the case of Ti, W, Zr, Nb, Ta these are powders of pure metals or powders of alloys of these metals with other elements, or mixtures thereof.

Preferably, moderator powders from the group of metals consist of a powder selected from the group of Fe, Co, Ni, Mo, Cr, W, Al, or of a mixture of said powders. In particular, preferably, the moderator powders further comprise at least one powder selected from the group of Mn, Si, Cu, B, or a mixture thereof.

Also preferably, the moderator powders have the chemical composition of an alloy selected from the group comprising grey cast iron, white cast iron, chromium cast iron, cast chromium steel, cast unalloyed steel, cast low-alloy steel, cast Hadfield manganese steel or Ni-Hard4 chromium cast iron containing Ni.

In another embodiment of the composition according to the invention, the moderator powder is a mixture of powders selected from the group of: (a) Fe, Cr, Mn, Si, Mo, C; (b) Fe, Cr, Mn, Si, C; (c) Co, Cr, W, C; (d) Co, Fe, Ni, Mo, Cr, C; (e) Ni, Cr, Mo, Nb, Al, Ti, Fe, Mn, Si; (f) Ni, Cr, Co, W, Nb, Al, Ti, C, B, Zr; (g) Co, Ni, Fe.

Preferably, the moderator powders also include powders of ceramic phases increasing the resistance to wear, in particular powders selected from the group of $ZrO_2$, stabilized $ZrO_2$, $Al_2O_3$, or a mixture thereof, and/or a reducing component in the form of Al and/or Si, wherein the amount of the reducing component in the powder composition is maximum 5 wt %.

The essence of the present invention is also a casting insert to produce wear-resistant local composite zones in castings, wherein said casting insert comprises the reactants of the carbide and/or boride formation, and wherein said casting insert is in the form of shapes, solids, preforms or granules, and is characterized in that it comprises a compacted powder composition according to the invention.

In yet another embodiment, the invention also relates to a method for producing local composite zones in castings, involving the reaction of self-propagating high temperature synthesis (SHS), wherein a powder mixture comprising the reactants of the carbide and/or boride formation is prepared, said powder mixture being next subjected to compaction, conferring to the compacted powder mixture the form of particular shapes, solids, preforms or granules which serve as casting inserts, placing next at least one casting insert in the interior of the mould, and pouring next said mould with molten casting alloy in an amount sufficient to initiate the SHS reaction, and wherein said invention is characterized in that a powder mixture comprising the reactants of the carbide and\or boride formation is prepared, said powder mixture making powder composition according to the invention.

Preferably, the prepared powder mixture is dried, preferably at a temperature of 200° C. until the content of moisture is maximum 2%.

Preferably, the operation of compaction is performed under a pressure ranging from 450 MPa to 650 MPa.

Preferably, the casting insert is placed in the mould cavity in a predetermined position and is fixed to the mould with bolts or is placed on a steel frame, said frame being placed inside the mould cavity, wherein preferably the steel frame consists of rods onto which the compacts having the holes are threaded.

Owing to the use of moderator, the composite zones produced in situ in castings are characterized by stable and predictable size, and crystals of titanium carbide TiC have similar submicron dimensions. The presence of a large number of the fine crystals of titanium carbide TiC of a relatively uniform distribution imparts to the composite zone an improved abrasive wear resistance and also an improved impact strength, as in the vicinity of fine crystals the mechanical stress is reduced, while smaller distances between these crystals increase the resistance of the composite zone to erosion.

The method according to the present invention provides a much more precise control of the SHS process during casting. As already mentioned, the typical SHS process is a self-sustained reaction, which once initiated proceeds rapidly until all the input material is reacted. Since the reaction is highly exothermic and results in a rapid increase of temperature combined with the emission of gases, there is an imminent risk of the formation of cavities and pores. In an embodiment according to the present invention, through careful selection of the composition of the moderator, wherein said moderator composition not only has the ability to effectively absorb the excess heat but has also the ability to increase hardness and wear resistance of the composite matrix, and additionally has the ability to absorb gases, the aforementioned drawbacks have been minimized.

Within the description of the invention and patent claims, the following terms shall be construed as defined below:

The term "metal powder" is intended to mean any metal in any form disintegrated to powder by any arbitrary method.

The term "moderator" is intended to mean a mixture of metal powders, said mixture optionally containing also non-metals, wherein said metal powders during the reaction of the SHS synthesis of selected carbide or of a mixture of carbides undergo melting and form a matrix of the composite zone. The fundamental role of moderator introduced to the reactants of the formation of a compound undergoing the SHS reaction is to reduce the amount of dissipated energy, which is possible due to the replacement of a part by weight of the reactants with said moderator. The task of the moderator is therefore to reduce the reactive infiltration, which occurs during the highly exothermic SHS synthesis of selected ceramic phase, and along with the reactive infiltration to reduce also the adverse phenomenon known as destructive fragmentation of the in situ generated composite zones. An additional task of the moderator is to reduce the size of particles formed as a result of the reaction of the SHS synthesis, which is achieved through the moderator impact on the crystallization process of the particles. The presence of the moderator also results in a relatively uniform distribution of particles within the composite zones and increases hardness and wear resistance of these zones.

The term "ceramic moderator" is intended to mean a ceramic powder, preferably of $ZrO_2$ and/or $Al_2O_3$, which is incorporated to increase the abrasive wear resistance of composite zones, to control the phenomenon of reactive infiltration and to reduce the adverse effect of total fragmentation.

The term "reducing component" is intended to mean an addition of powder, preferably of Al and/or Si, incorporated in order to bind the atoms of gas released during the reaction of the SHS synthesis proceeding in casting within the in situ generated composite zones and also to reduce or eliminate the defects in the form of porosity.

The term "casting insert" is intended to mean a densified powder composition, incorporated in order to produce in situ in casting the composite zones reinforced with carbides and/or oxides, a key element in said casting insert being the addition of a moderator. The moderator present in the casting insert prevents the occurrence of an adverse phenomenon of the fragmentation of composite zones, resulting in that said zones are broken into pieces and can move in molten alloy poured into the mould cavity. The casting insert can assume the shape of any arbitrary solid body or preform, or it can be used in the form of granules. It is placed in mould cavity and should be fixed therein in such a way as to prevent its movement in the casting during pouring of the mould cavity.

The term "base alloy" is intended to mean a casting alloy which is poured into the mould cavity with the casting insert disposed in the interior of said mould cavity to produce the composite zones in casting.

BRIEF DESCRIPTION OF SEVERAL VIEWS OF THE DRAWINGS

The object of the present invention is now explained in the embodiments that do not limit its scope and in the drawings, wherein.

Figure 1:
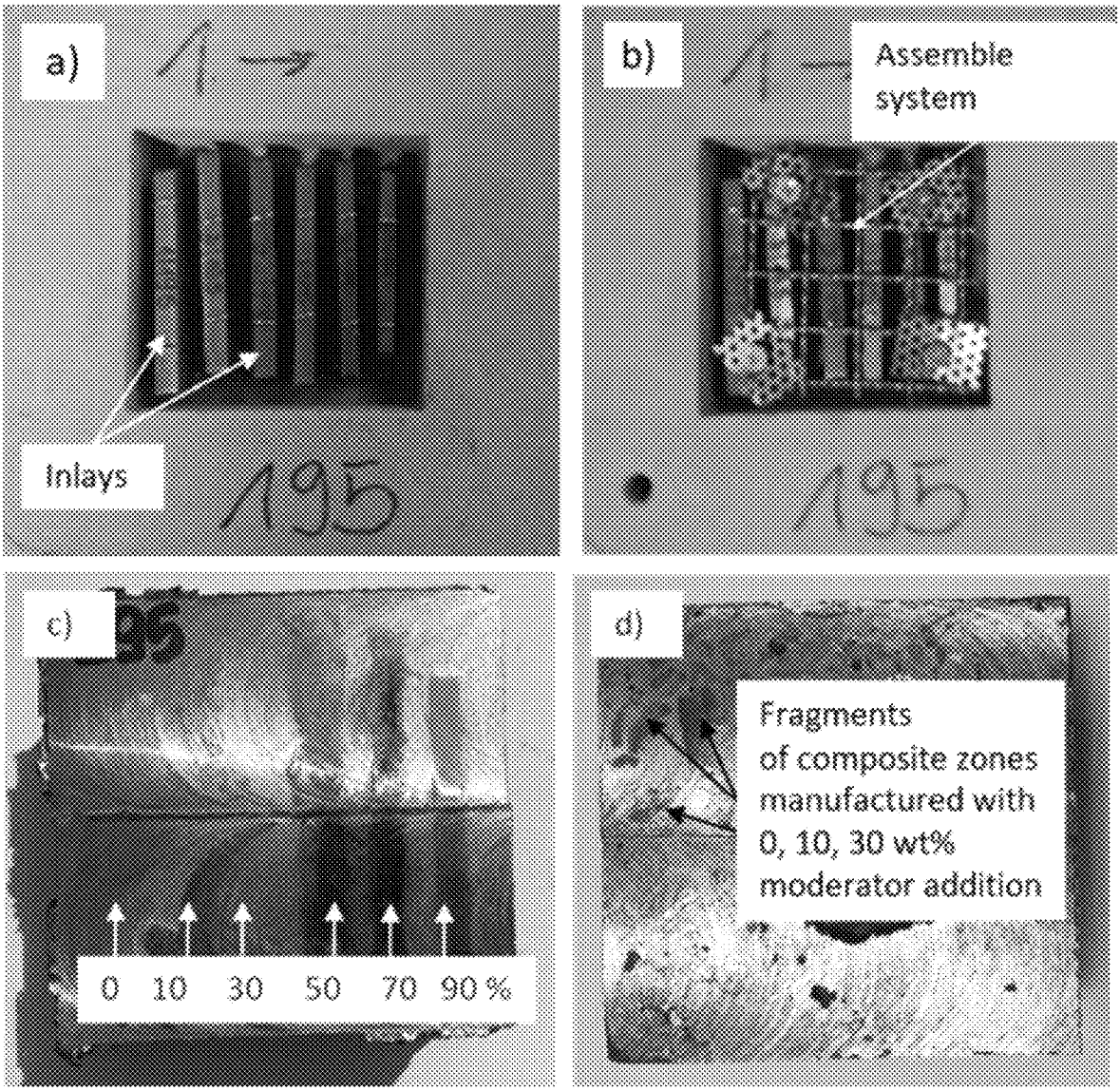
FIG. 1 shows the sequential steps of a method for producing composite zones in castings, including a mould cavity wherein the casting inserts are placed (a), a method for fixing said casting inserts in position (b), composite zones visible in the milled cross-section of the bottom part of casting (c), and in the milled cross-section of the upper part of casting, the latter one showing scattered fragments of said composite zones produced from casting inserts containing the reactants of titanium carbide (TiC) formation and less than 50 wt % of a moderator powder in the form of cast Hadfield high-manganese steel with 21 wt % Mn (d)

The present invention is now illustrated by the following examples of its embodiments.

DETAILED DESCRIPTION OF THE DRAWING

Example 1

In Example 1, the mould cavity and casting inserts were prepared for the fabrication of composite zones reinforced with TiC carbide (FIG. 1*a*), including the operation of fixing said casting inserts by means of an assembly system in said mould cavity (FIG. 1*b*). The casting inserts were made from a powder mixture comprising the reactants of TiC formation and a moderator having the composition of cast high-manganese steel containing 21% Mn. The composition of the powder mixture used for the fabrication of casting inserts and the obtained results are included in Table 1. Symbols "+" and "–" in Tables 1-6 stand for the answers "yes" and "no", respectively, in a schematic description of the results of examinations of the polished cross-section of a casting with the composite zones fabricated by an in situ method. The chemical composition of a moderator in the form of cast Hadfield high-manganese steel is given in Table 8.

TABLE 1

| Sample No. | A1 | A2 | A3 | A4 | A5 | A6 |
|---|---|---|---|---|---|---|
| Reactants of TiC formation [wt %] | 100 | 90 | 70 | 50 | 30 | 10 |
| Moderator having the composition of cast Hadfield high-manganese steel with 21% Mn [wt %] | 0 | 10 | 30 | 50 | 70 | 90 |
| The visibility of composite zones | − | − | − | + | + | + |
| Total fragmentation of composite zone | + | + | + | − | − | − |
| Partial fragmentation of composite zone | − | − | − | + | − | − |
| The content of macroporosity and fragments of composite zone in the upper part of casting | + | + | + | − | − | − |

Figure 2:
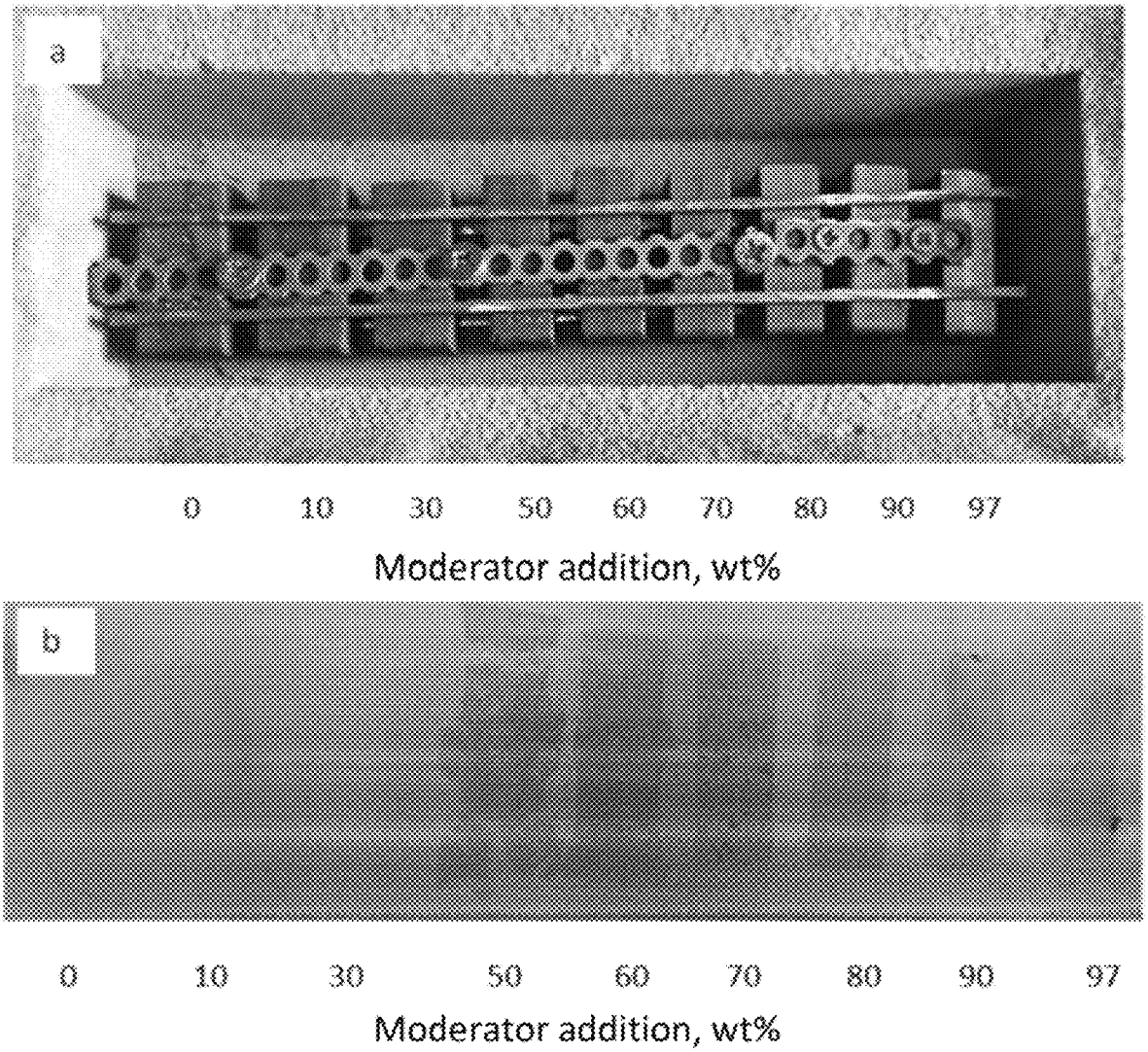
FIG. 2 shows a mould cavity wherein the casting inserts are placed (a), and a polished cross-section of the casting (b), when the composite zones are fabricated from materials containing the reactants of titanium carbide (TiC) formation and a moderator powder in the form of pure iron.

In the first experiment, casting inserts were fixed in the mould cavity to produce composite zones reinforced with titanium carbide TiC, as shown in FIGS. 1*a* and 1*b*. The inserts contained various amounts of the moderator in the form of a powder mixture having the composition of cast Hadfield high-manganese steel with 21 wt % Mn and reactants of the titanium carbide TiC formation. The atomic ratio of the reactants was 50 at % Ti:50 at % C. The inserts were made by compaction under a pressure of 600 MPa and had dimensions of 20×100×X mm, where X for individual inserts was from 8 to 15 mm, respectively. Next, a 6 kg weighing casting measuring 70×150×150 mm was made from the L35GSM steel and had the composite zones visible in FIG. 1*c* formed in situ from the casting inserts containing 50 wt %, 70 wt % and 90 wt % of the moderator addition in zones A4 to A6, respectively, whereas the composite zones formed in situ from the casting inserts containing 0 wt %, 10 wt % and 30 wt % of the moderator addition were scattered and invisible (the area marked with symbols A1 to A3 in FIG. 1*c*). Fragments of the scattered composite zones are visible in the milled upper casting surface shown in FIG. 1*d*.

and macroporosity defects disappear in respective zones. As shown in FIGS. 1 and 2, at 70 wt % content of the moderator, the macroscopically optimal dimensional stability and the lowest fraction of macroporosity are obtained in castings. Using this moderator, the relative dimensional stability is obtained only in those zones in which the percent content of the moderator powder exceeds 50 wt %. The, visible in FIG. 1*d*, top surface of the casting shows fragments of composite zones obtained with the moderator addition of 0 wt %, 10 wt %, 30 wt %, wherein said composite zones during the in situ reaction of TiC synthesis in molten alloy have undergone the process of fragmentation and floated to the top. This effect was observed in a series of 15 tests. The results of experimental studies have also indicated that when the casting inserts for the in situ fabrication of composite zones in castings contain only powder reactants of the TiC synthesis, local composite zones are not formed due to the disadvantageous phenomenon of the fragmentation of these zones.

In the second experiment, the mould cavity and casting inserts were prepared for the fabrication of composite zones reinforced with TiC carbide (FIG. 2*a*), including the operation of fixing said casting inserts by means of an assembly system in said mould cavity. The casting inserts were made from a powder mixture comprising the reactants of TiC formation and a moderator having the composition of pure Fe powder added in the amounts as indicated in Table 2. The composition of the powder mixture used for the fabrication of casting inserts and the obtained results are included in Table 2. The atomic ratio of the reactants was 55 at % Ti:45 at % C. The inserts were made by compaction under a pressure of 500 MPa and had dimensions of 20×50×X mm, where X for individual inserts was from 15 to 25 mm, respectively.

TABLE 2

| Sample No. | B1 | B2 | B3 | B4 | B5 | B6 | B7 | B8 | B9 |
|---|---|---|---|---|---|---|---|---|---|
| Reactants of TiC formation [wt %] | 100 | 90 | 70 | 50 | 40 | 30 | 20 | 10 | 3 |
| Moderator having the composition of pure Fe powder [wt %] | 0 | 10 | 30 | 50 | 60 | 70 | 80 | 90 | 97 |
| The visibility of composite zones | − | − | − | + | + | + | + | + | + |
| Total fragmentation of composite zone | + | + | + | − | − | − | − | − | − |
| Partial fragmentation of composite zone | − | − | − | + | − | − | − | − | − |
| The content of macroporosity and fragments of composite zone in the upper part of casting | + | + | + | − | − | − | − | − | − |

Figure 3:
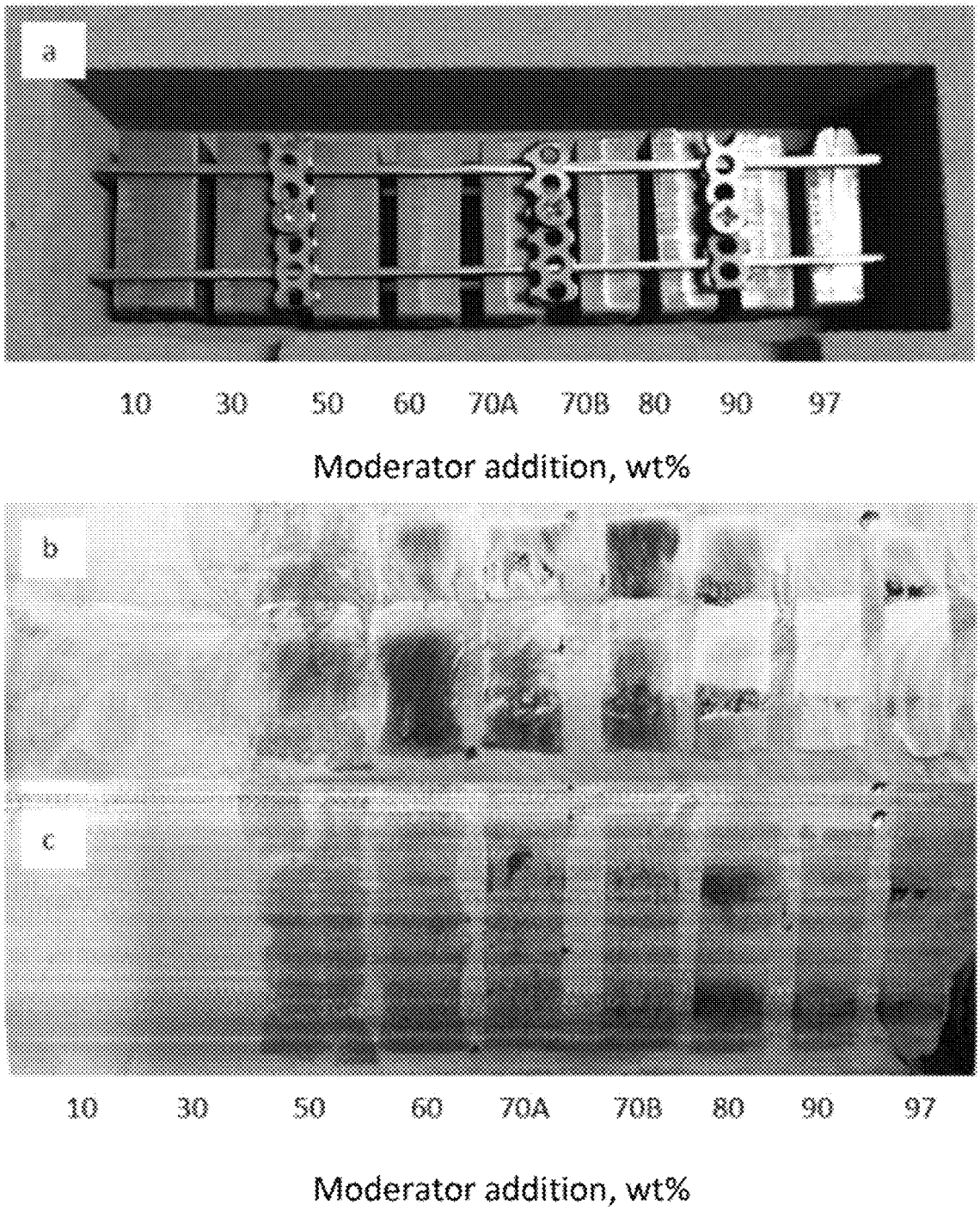
FIG. 3 shows a mould cavity wherein the casting inserts are placed (a), a milled cross-section of the casting (b), and a polished cross-section of the casting (c), when the composite zones are fabricated from materials containing the reactants of titanium carbide (TiC) formation and a moderator powder in the form of cast Hadfield high-manganese steel with 21 wt % Mn.

The composite zones produced without the addition of moderator and with the addition of moderator in an amount of 10 wt % and 30 wt % (compacts A1, A2 and A3, respectively, Table 1) have undergone the process of fragmentation (FIG. 1*c*) with a significant share of macroporosity and fragments of composite layer present in the upper part of casting (FIG. 1*d*). This macrostructure was the result of intense infiltration induced by a significant increase in temperature during the reaction of the SHS synthesis of titanium carbide TiC caused by the absence of moderator. Since the reaction of synthesis is highly exothermic, the significant increase in temperature promotes the process of infiltration as well as the production and dissolution of gases. As a result, stable composite zones are not obtained in the casting; instead only randomly distributed fragments of these zones containing TiC carbide are present. With the growing percent content of moderator addition having the composition of cast high-manganese steel with 21% Mn, the tendency towards dimensional stabilization starts prevailing In the third experiment, casting inserts to produce the composite zones reinforced with TiC carbide were fixed in the mould cavity, as shown in FIG. 3*a*. The inserts contained various amounts of the moderator powder having the composition of cast high-manganese steel with 21 wt % Mn. The composition of the powder mixture used for the fabrication of casting inserts and the obtained results are included in Table 3. The atomic ratio of the reactants was 55 at % Ti: 45 at % C. The inserts were made by compaction under a pressure of 500 MPa and had dimensions of 20×50×X mm, where X for individual inserts was from 15 to 25 mm, respectively. Then, in a 7 kg weighing casting made from the L450 steel with dimensions of 43×70×250 mm and a wall thickness of 48 mm, two cross-sections were prepared by milling (FIG. 3*b*) and polishing (FIG. 3*c*). In both cross-sectional areas are visible the composite zones fabricated in situ from the casting inserts containing 50 wt %, 60 wt %, 70 wt % A, 70 wt % B, 80 wt %, 90 wt % and 97 wt % of the moderator addition in samples C3-C8, respectively, whereas composite zones containing 10 wt % and 30 wt % of the moderator addition in samples C1-C2, respectively, are dispersed and invisible because of the total fragmentation effect taking place in casting. The zone produced with 50 wt % of the moderator addition has undergone partial fragmentation, as proved by the presence of molten alloy penetrating into the zone and splitting it into smaller fragments.

TABLE 3

| Sample No. | C1 | C2 | C3 | C4 | C5 | C6 | C7 | C8 | C9 |
|---|---|---|---|---|---|---|---|---|---|
| Reactants of TiC formation [wt %] | 90 | 70 | 50 | 40 | 30A | 30B | 20 | 10 | 3 |
| Moderator having the composition of cast Hadfield high-manganese steel with 21% Mn [wt %] | 10 | 30 | 50 | 60 | 70A | 70B | 80 | 90 | 97 |
| The visibility of composite zones | − | − | + | + | + | + | + | + | + |
| Total fragmentation of composite zone | + | + | − | − | − | − | − | − | − |
| Partial fragmentation of composite zone | − | − | + | − | − | − | − | − | − |
| The content of macroporosity and fragments of composite zone in the upper part of casting | + | + | − | − | − | − | − | − | − |

Figure 4:
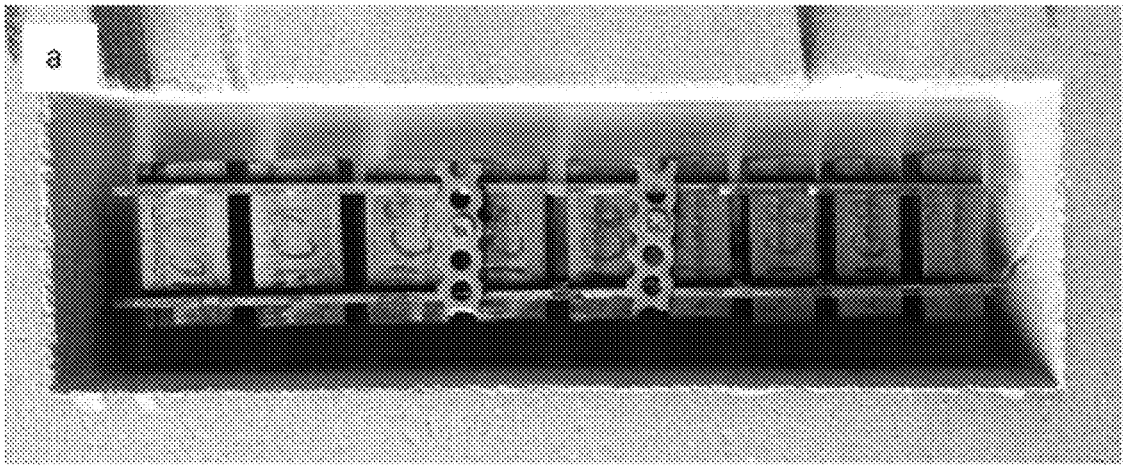
FIG. 4 shows a mould cavity wherein the casting inserts are placed (a), a milled cross-section of the casting (b), and a polished cross-section of the casting (c), when the composite zones are fabricated from materials containing the reactants of titanium carbide (TiC) formation and a moderator powder in the form of Ni-Hard4 chromium cast iron containing Ni.
Figure 4:
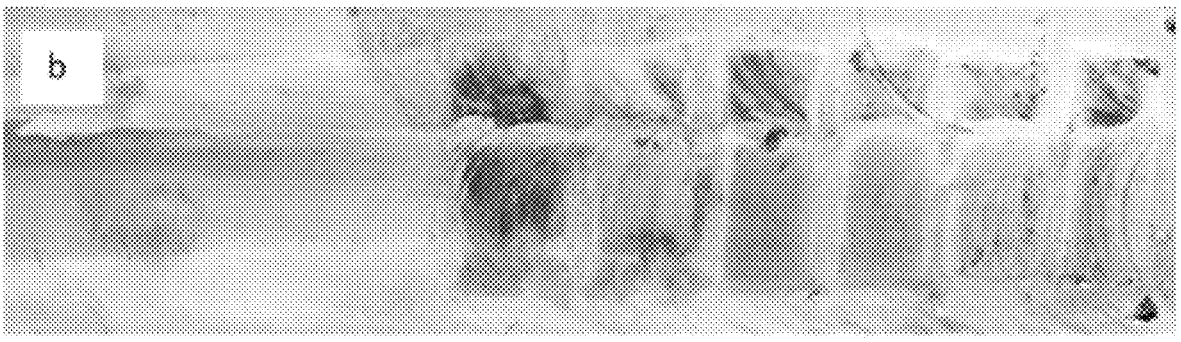
Figure 4:
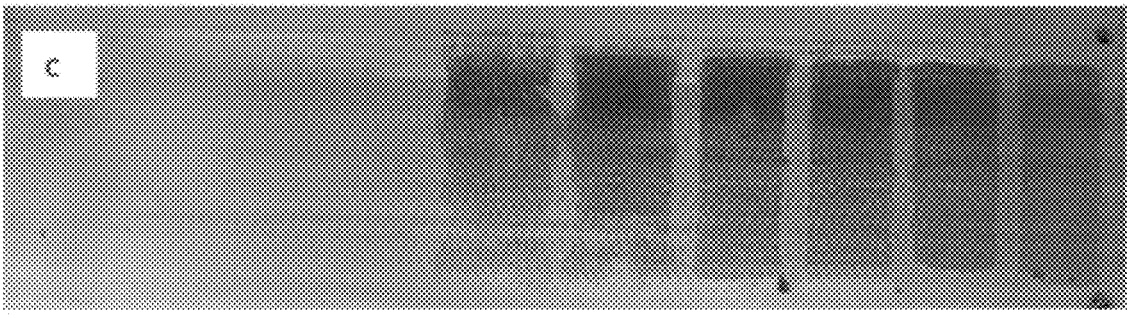

In the fourth experiment, the powder compositions were tested for the fabrication of local composite zones reinforced with TiC carbide, which contained the addition of moderator in the form of a powder mixture having the composition of Ni-Hard4 chromium cast iron containing Ni. The composition of the powder mixture used for the fabrication of casting inserts and the obtained results are included in Table 4. The atomic ratio of the reactants was 55 wt % Ti:45 at % C. The inserts were made by compaction under a pressure of 500 MPa and had dimensions of 20×50× X mm, where X for individual inserts was from 15 to 25 mm, respectively. The casting inserts were fixed in the mould cavity as shown in FIG. 4*a*. The mould cavity with the casting inserts fixed therein was poured with the L450 alloy having the composition as shown in Table 8. In this way, a 7 kg weighing casting measuring 43×70×250 mm with a wall thickness of 48 mm and with the composite zones present therein was produced. Then, two cross-sections of the L450 steel casting were prepared by milling (FIG. 4*b*) and polishing (FIG. 4*c*). In both cross-sectional areas are visible the composite zones fabricated in situ from the casting inserts containing 50 wt %, 60 wt %, 70 wt %, 80 wt %, 90 wt % and 97 wt % of the moderator addition in samples C3-C8, respectively, whereas composite zones containing 0 wt %, 10 wt % and 30 wt % of the moderator addition in samples C1-C2, respectively, are dispersed and invisible because of the total fragmentation effect taking place in casting. The zone produced with 50 wt % of the moderator addition has undergone partial fragmentation, as proved by the presence of molten alloy penetrating into the zone and splitting it into smaller fragments.

TABLE 4

| Sample No. | D1 | D2 | D3 | D4 | D5 | D6 | D7 | D8 | D9 |
|---|---|---|---|---|---|---|---|---|---|
| Reactants of TiC formation [wt %] | 100 | 90 | 70 | 50 | 40 | 30 | 20 | 10 | 3 |
| Moderator having the composition of Ni—Hard4 chromium cast iron containing Ni [wt %] | 0 | 10 | 30 | 50 | 60 | 70 | 80 | 90 | 97 |
| The visibility of composite zones | − | − | − | + | + | + | + | + | + |
| Total fragmentation of composite zone | + | + | + | − | − | − | − | − | − |
| Partial fragmentation of composite zone | − | − | − | + | − | − | − | − | − |
| The content of macroporosity and fragments of composite zone in the upper part of casting | + | + | + | − | − | − | − | − | − |

In the implementation of experimental studies, the casting wall thickness was set in the range of 50 to 150 mm, which is a typical value for a number of cast structural components used in the conical, jaw, hammer and impact crushers, and also for the rolls or balls of ball or roller mills. In the aforementioned range of values, the composite zones produced with the moderator content exceeding 60 wt % were stable and did not undergo fragmentation. For heavier casting walls, powder compositions with higher content of the moderator can be used to reduce infiltration and produce stable composite zones in such castings.

Example 2

In Example 2, casting inserts were fixed in the mould cavity to produce composite zones reinforced with WC carbide as shown in FIG. 5*a*. The casting inserts contained the reactants of WC carbide formation and varying amounts of the powder moderator having the composition of NiHard 4 white cast iron containing Ni. The composition of the powder mixture used for the fabrication of casting inserts and the obtained results are included in Table 5. The atomic ratio of the reactants to form WC carbide was 94.93% W: 5.07% C. The moderator used for the manufacture of casting inserts E2-E9 contained the addition of a deoxidizer in the form of Al powder introduced in an amount of 2 wt %. The inserts were made by compaction under a pressure of 500 MPa and had dimensions of 20×50×X mm, where the value of dimension X depended on the compactability of individual powder compositions. Compacts E1-E8 were made from samples of powder compositions weighing 100 g each, whereas compact E9 was made from a sample weighing 150 g. Then, polished cross-section was made (FIG. 5*b*) in a 7 kg weighing L450 steel casting measuring 43×70×250 mm and with a wall thickness of 48 mm. The polished cross-sectional area shows the presence of composite zones formed in situ from the casting inserts E1-E5, wherein said inserts have produced the dimensionally stable zones reinforced with WC carbide, whereas zones E6-E9 have defects resulting from the incomplete reaction taking place in compacts with a higher content of the moderator. This points out to a different nature of the reaction of the SHS synthesis of the formation of titanium carbide TiC and tungsten carbide WC. In the case of TiC, high energy accompanying the reaction of synthesis and a relatively low activation energy result in the fragmentation of the composite zone, and therefore preferably the addition of moderator should be used in amounts exceeding 60 wt %, whereas in the case of WC carbide, said moderator should preferably be used in amounts not exceeding 60 wt %, since higher content of this moderator tends to suppress the reaction and make it inefficient. This causes defects in the area of the composite zone. The energy associated with the reaction of the SHS synthesis and the activation energy are different for TiC carbides and WC carbides, and therefore the formation of composite zones in castings proceeds in a different way and depends on the type of the carbide used, thus requiring different ranges of the content of moderator addition. In the composite zones based on WC carbide, the phenomenon of fragmentation does not occur and these zones can be produced with a low content of the moderator.

TABLE 5

| Sample No. | E1 | E2 | E3 | E4 | E5 | E6 | E7 | E8 | E9 |
|---|---|---|---|---|---|---|---|---|---|
| Reactants of TiC formation [wt %] | 100 | 90 | 70 | 50 | 40 | 30 | 20 | 10 | 3 |
| Moderator having the composition of Ni—Hard4 chromium cast iron containing Ni [wt %] | 0 | 10 | 30 | 50 | 60 | 70 | 80 | 90 | 97 |
| The visibility of composite zones | + | + | + | + | + | − | − | − | − |
| Total fragmentation of composite zone | − | − | − | − | − | − | − | − | − |
| Partial fragmentation of composite zone | − | − | − | − | − | − | − | − | − |
| The presence of macroporosity and absence of reaction | − | − | − | − | − | + | + | + | + |

Example 3

In Example 3, casting inserts were fixed in the mould cavity to initiate the coupled reaction of the SHS synthesis and produce the (Ti, W)C carbide as shown in FIG. 6*a*. The casting inserts contained the TiC and WC reactants of the coupled SHS synthesis of the (Ti, W)C carbide and varying amounts of the moderator in the form of a powder mixture having the composition of NiHard4 white cast iron containing Ni. The composition of the powder mixture used for the fabrication of casting inserts and the obtained results are included in Table 6. The weight fraction of the reactants was 50% TiC (where 55 at % Ti:45 at % C) and 50 wt % WC (where 94.93 at % W: 5.07 at % C). The moderator used for the manufacture of casting inserts F1-F4 contained the addition of a deoxidizer in the form of Al powder introduced in an amount of 5%, whereas in the case of inserts F5-F8, the amount of the deoxidizer was reduced to 0.1%. The inserts were made by compaction under a pressure of 500 MPa and had dimensions of 20×60×X mm, where the value of dimension X depended on the compactability of individual powder compositions. Then polished cross-section was made (FIG. 5*b*) in a 7 kg weighing LGS30 steel casting measuring 43×70×250 mm and with a wall thickness of 48 mm, said polished cross-section being made on the top surface (FIG. 6*b*) of the casting and on the lateral surface (FIG. 6*c*) of the casting. Both cross-sectional areas showed the presence of composite zones formed in situ from the casting inserts. The use of the coupled reaction of the SHS synthesis of the TiC and WC carbides produced the dimensionally stable and fragmentation-resistant composite zones reinforced with (Ti, W)C carbide with the moderator content of from 55 to 89.9 wt %. Macroscopic observations revealed the presence of gas defects in zones F6-F8 produced with a low content of the Al deoxidizer added in an amount of 0.1 wt %, whereas zones produced with the addition of 5 wt % Al were free from the porosity defects.

TABLE 6

| Sample No. | F1 | F2 | F3 | F4 | F5 | F6 | F7 | F8 |
|---|---|---|---|---|---|---|---|---|
| Reactants of (Ti, W)C carbide formation [wt %] | 40 | 30 | 20 | 10 | 40 | 30 | 20 | 10 |
| The amount of deoxidizer in the form of pure | 5 | 5 | 5 | 5 | 0.1 | 0.1 | 0.1 | 0.1 |

TABLE 6-continued

| Sample No. | F1 | F2 | F3 | F4 | F5 | F6 | F7 | F8 |
|---|---|---|---|---|---|---|---|---|
| Al powder [wt %] | | | | | | | | |
| Moderator having the composition of Ni—Hard4 chromium cast iron containing Ni [wt %] | 55 | 65 | 75 | 85 | 59.9 | 69.9 | 79.9 | 89.9 |
| The visibility of composite zones | + | + | + | + | + | + | + | + |
| Total fragmentation of composite zone | – | – | – | – | – | – | – | – |
| Partial fragmentation of composite zone | – | – | – | – | – | – | – | – |
| The content of macroporosity and defects in the form of blowholes | – | – | – | – | – | + | + | + |

For selected materials used in the fabrication of local composite zones according to the present invention, microstructure was examined in a cross-section of the transition region located between the composite zone and the remaining part of the steel casting and also in a cross-section of the composite zone. Tests were performed on experimental models included in Table 7.

TABLE 7

Figure 5:
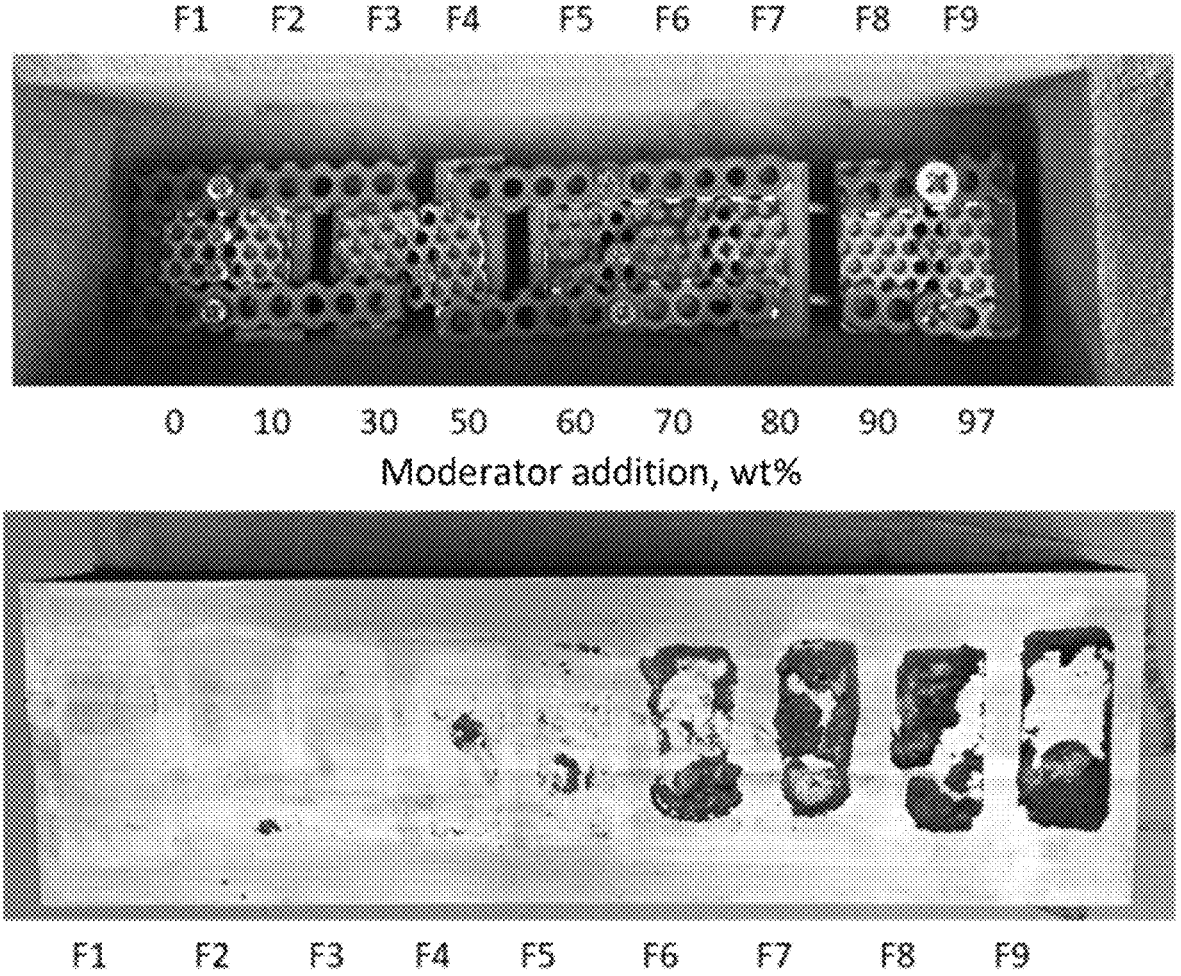
FIG. 5 shows a mould cavity wherein the casting inserts are placed (a), and a polished cross-section of the casting (b), when the composite zones are fabricated from materials containing the reactants of tungsten carbide (WC) formation and a moderator powder in the form of Ni-Hard4 chromium cast iron containing Ni.
Figure 6:
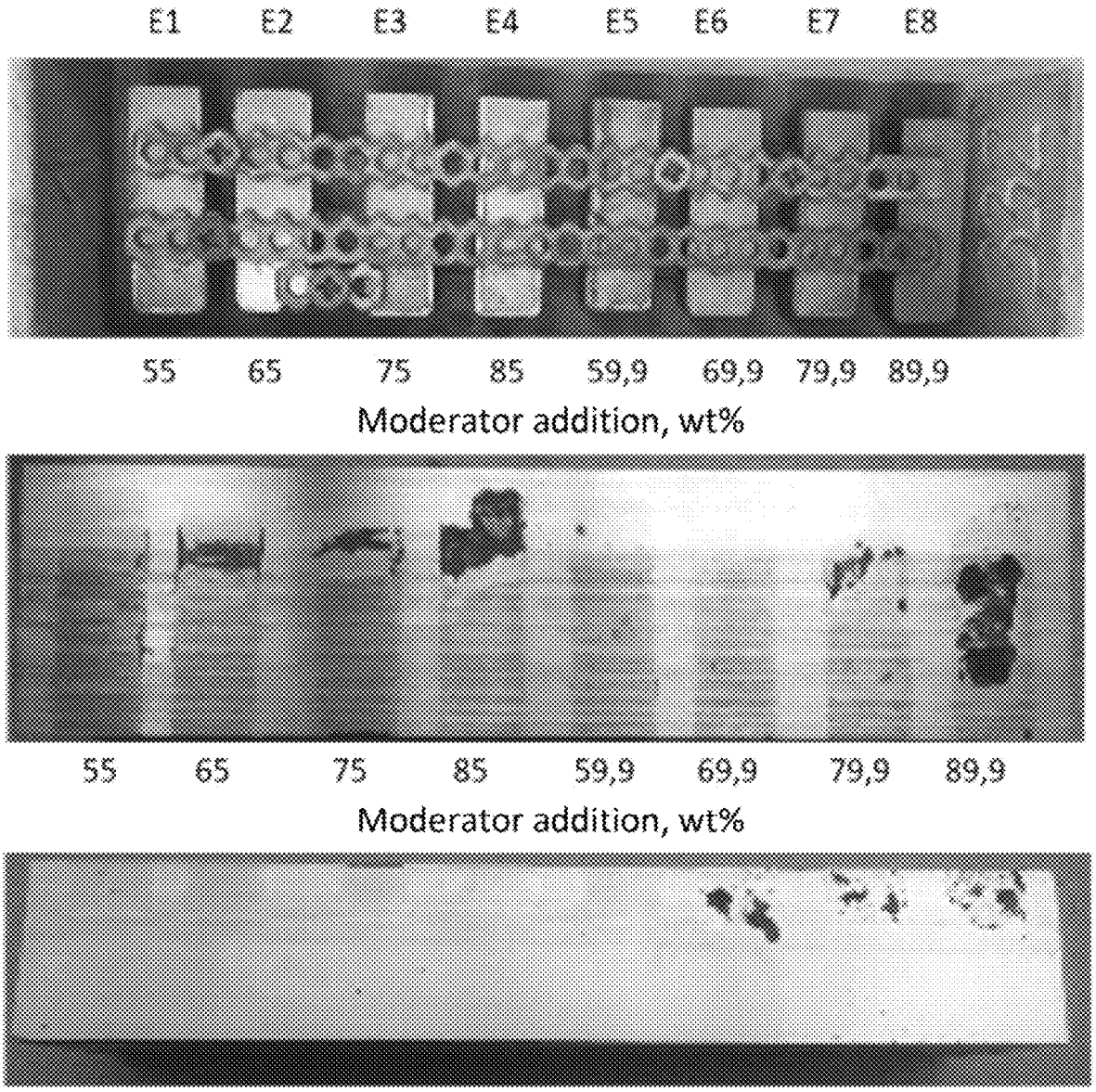
FIG. 6 shows a mould cavity wherein the casting inserts are placed (a), and polished cross-sections of the casting (b-c), when the composite zones are fabricated from materials containing the reactants of the coupled formation of titanium carbide and tungsten carbide (TiC, WC) and a moderator powder in the form of Ni-Hard4 chromium cast iron containing Ni.
Figure 7:
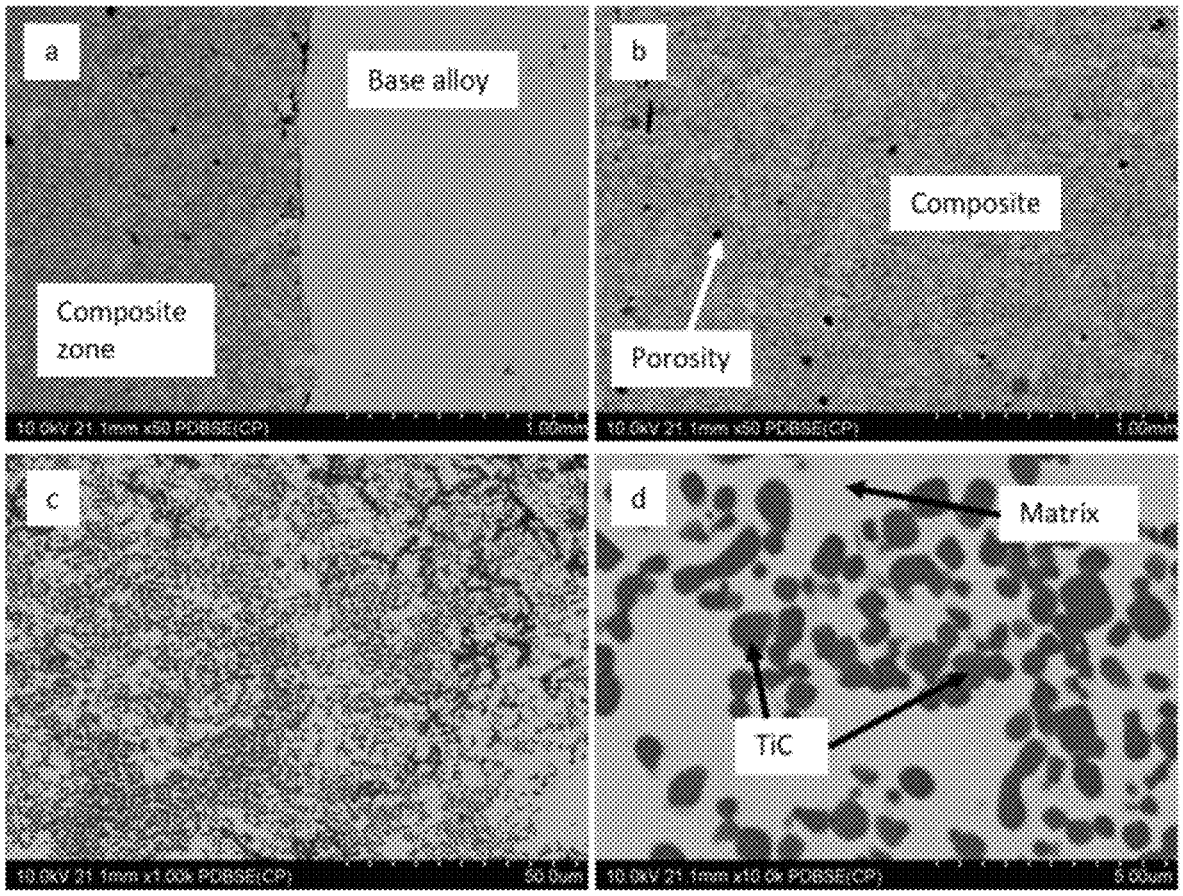
FIG. 7-9 show microstructure in a cross-section of the transition region located between the composite zone and the rest of casting and microstructure of the composite zone, wherein said microstructure depends on the composition of a powder mixture used for the fabrication of casting inserts, including the amount of moderator.
Figure 8:
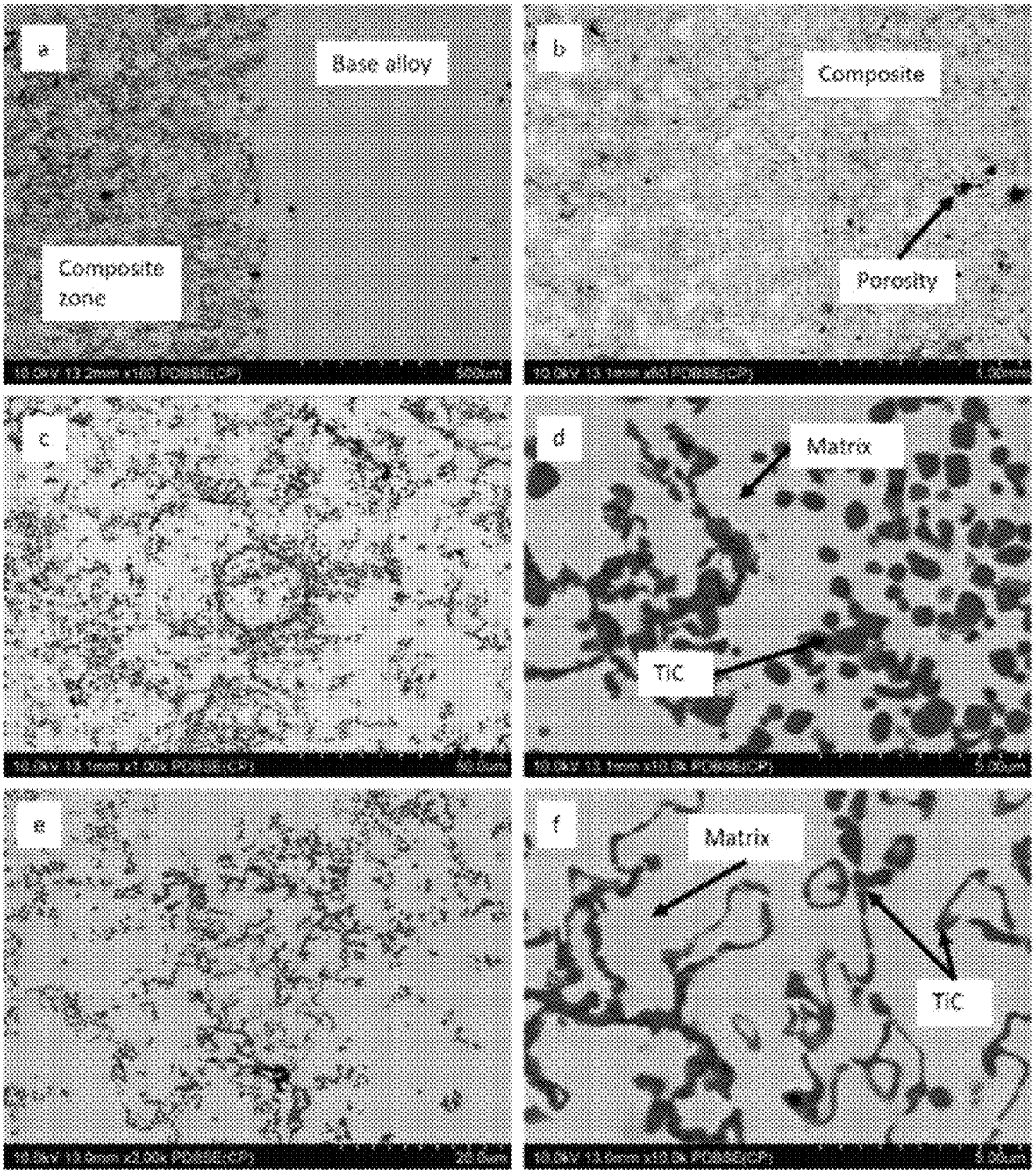
Figure 9:
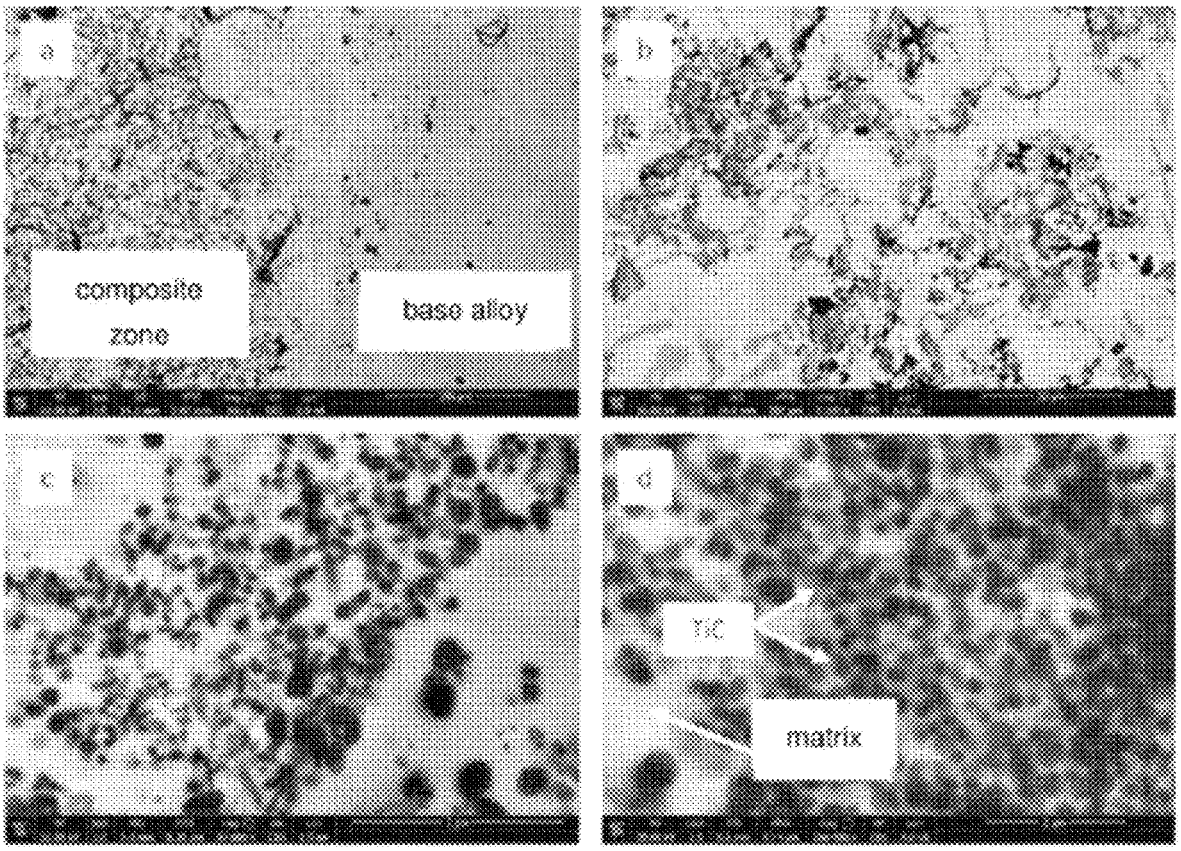
Figure 10:
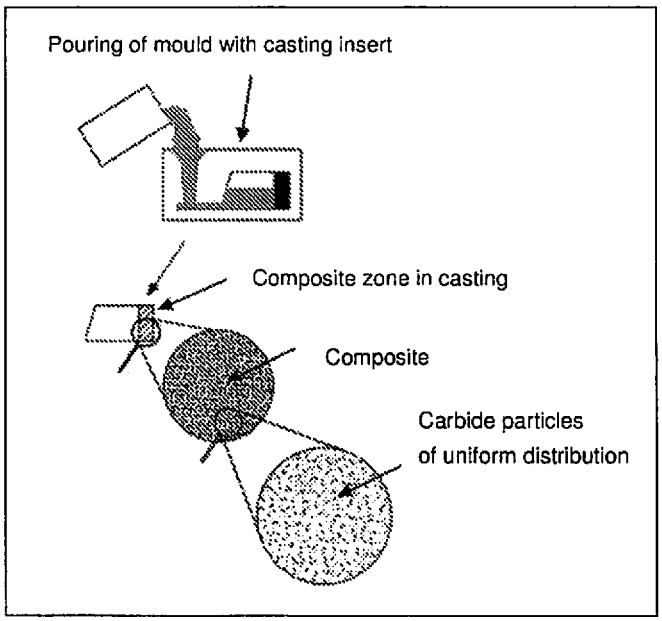
FIG. 10 shows a general flow chart of a method for producing local composite zones in castings according to the invention.

| | Sample No. | | |
|---|---|---|---|
| | D1 | D2 | D9 |
| Matrix | cast L35GSM steel | cast L35GSM steel | cast L450 steel |
| Moderator type | Cast high-manganese steel with 21 wt % Mn | | Ni-Hard4 chromium cast iron |
| Moderator content | 70 wt % | 90 wt % | 97 wt % |
| Results | FIG. 5 | FIG. 6 | FIG. 7 |
| Comments | in each of FIGS. 7-9, photo (a) shows the cross-sectional view of transition region between the composite zone and the matrix, whereas FIGS. 7-9 (b)-(d) or (b)-(f) show magnified views of the composite zone | | |
| Effects observed | continuous phase boundary, absence of cracks and porosity, very good bond produced by infiltration | visible are submicron and nanometric particles of TiC | visible are submicron and nanometric particles of TiC |

TABLE 8

Chemical composition of moderators used in the examples of embodiments

| Composition of moderator | Chemical composition [wt %] | | | | | | |
|---|---|---|---|---|---|---|---|
| | C | Mn | Si | Ni | Cr | Mo | Fe |
| Cast Hadfield high-manganese steel with 21% Mn | 1.2 | 21 | 0.5 | — | — | — | rest |
| NiHard 4 chromium cast iron containing Ni | 3.6 | 0.8 | 2.2 | 5.5 | 10 | 0.5 | rest |
| High-chromium cast iron | 3.31 | 0.69 | 0.87 | — | 26.6 | 1.25 | rest |

FIGS. 7 and 8 show the images of microstructures of the composite zones produced in cast L35GSM steel. The composite zones were made from the casting inserts containing 70 wt % of moderator addition having the composition of cast Hadfield high-manganese steel with 21 wt % Mn, said moderator being a mixture of powders of Fe, FeMn, C, FeSi, Al. The transition region between the composite zone and the rest of casting visible in FIG. 7*a* is characterized by a strong bond obtained in the controlled process of infiltration and diffusion occurring in the liquid state between the area of the in situ reaction zone and liquid alloy poured into the mould cavity. The phase boundary between the composite zone and the rest of casting forms a straight line and is characterized by continuity and dimensional stability. The fabricated composite zone contains mainly the submicron-sized TiC carbides uniformly distributed within the area of the zone. The visible effect of fragmentation enhances surface development of the TiC carbide and its even distribution within the area of the zone, as observed in FIG. 7 *c-d*. FIG. 8 shows that with a high content of the moderator added in an amount of 90 wt %, the distribution of the crystals of titanium carbide TiC in the composite zone is less uniform, while clusters of the TiC crystals assume a specific shape of self-organizing structures in the form of rings and chains visible in FIG. 8*f*. The rings of these chains are of a submicron and nanometric thickness.

The use of moderator in powdered form favourably affects the nucleation kinetics and crystal growth in alloy melt during the reaction of the synthesis of carbides, such as, for example, TiC, WC, (W, Ti) C, and other carbides undergoing the SHS reaction that occurs between powder reactants of carbide formation contained in the powder mixture, said powder mixture forming after compaction a casting insert. Particularly preferred is the excellent dispersion of the crystals of, for example, TiC in a matrix of the composite zone. It allows obtaining favourable operating parameters of the composite zone at a relatively low percent content of carbides such as, for example, titanium carbide TiC. The addition of moderator, introduced as a mixture of metal and non-metal powders, significantly improves both hardness and wear resistance of the composite zones obtained in situ in castings.

Hardness testing was performed in local composite zones fabricated by the method according to the present invention from materials of different compositions with different content of the moderator according to the present invention. The results are shown in FIGS. 10-13. Hardness of composite zones was tested in 7 kg weighing castings measuring 43×70×250 mm with a wall thickness of 48 mm, wherein said composite zones were fabricated by the in situ method.

The results of Vickers hardness measurements shown in FIGS. 11-14 were obtained using samples of the size of 30 pieces each. Symbols used in the graphs denote: dot-the average value; dash-the 50% median; frame-confidence limits for the deviation 2σ; x, x-extreme values. Hardness was measured under a load of 9.807 N (HV1) (a) and 294.2N (HV30) (b).

In contrast to prior methods, the matrix of the composite zone according to the present invention can be made from materials of the chemical composition characterized by properties substantially different from the properties of the base casting alloy poured into the mould cavity. This allows careful selection of the alloy providing the predictable mechanical and functional properties, a repeatable process of synthesis and reproducible distribution of the crystals of carbides such as, for example, titanium carbide TiC in local composite zones.

Figure 11:
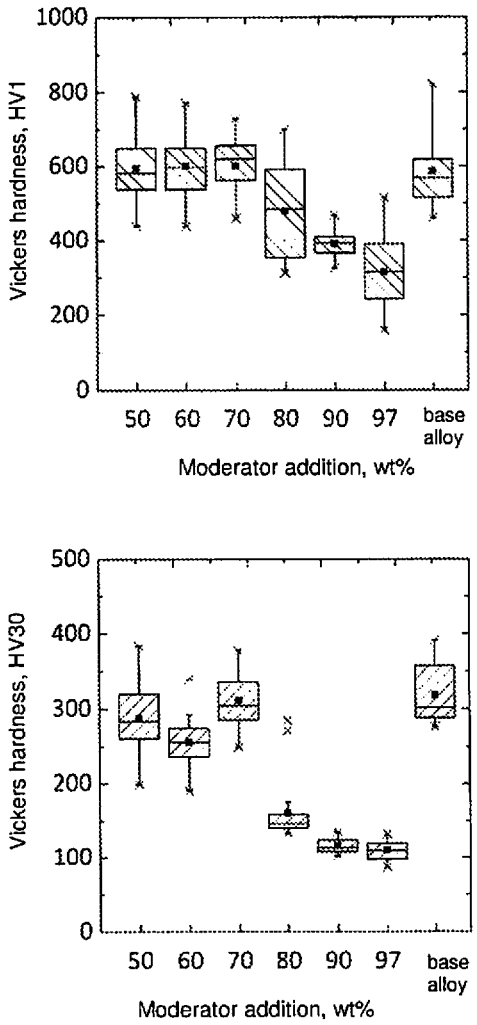
FIG. 11-16 show the relationship between changes in the hardness of composite zones produced in situ in the casting and composition of the powder mixture used for the manufacture of casting inserts, including the weight content of moderator incorporated in said powder mixture used for the manufacture of said inserts.
Figure 12:
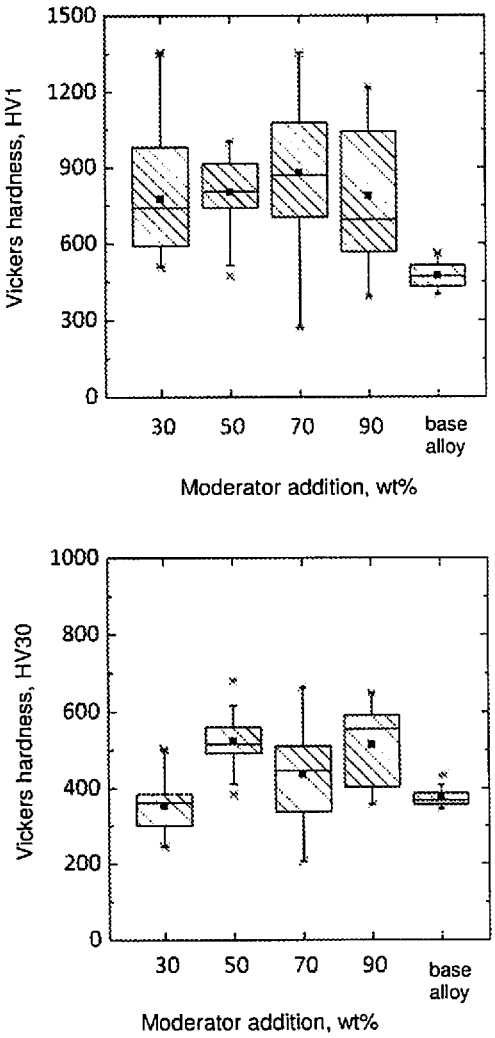
Figure 13:
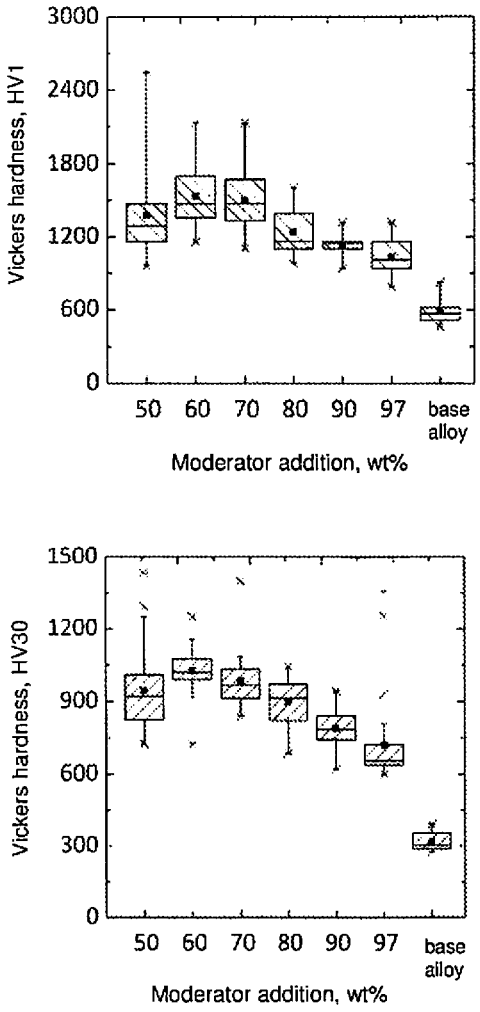
Figure 14:
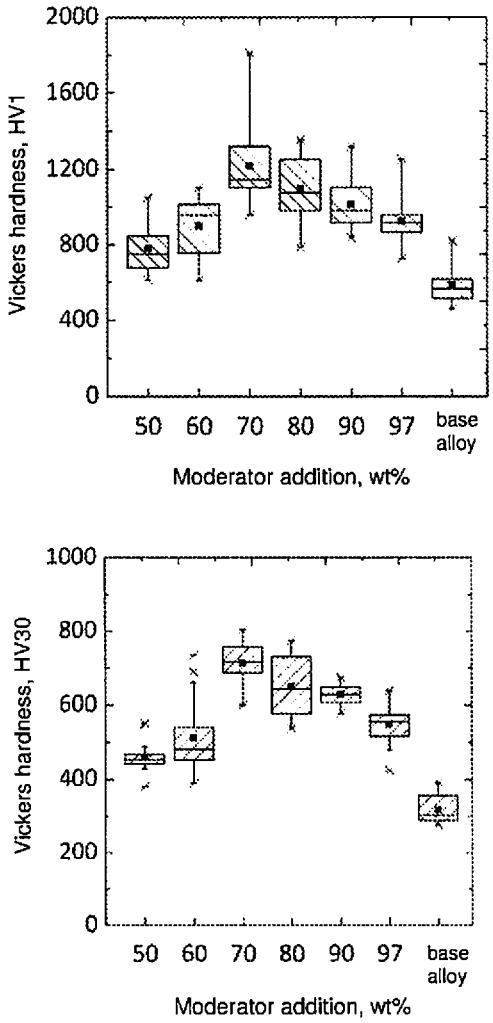

The preferred features of the new method are confirmed by the results of comparative hardness tests shown in FIGS. 11 and 12, wherein FIG. 11 shows the relationship between hardness of composite zones obtained in situ in a casting made from the L450 steel and the amount of moderator in the form of pure iron powder having properties close to the properties of the base casting alloy, whereas FIG. 12 shows the relationship between hardness of composite zones obtained in situ in a casting made from the L35GSM steel and the amount of moderator, wherein the applied reactants of the formation of titanium carbide TiC are mixed with moderator powders, which by the reaction of the SHS synthesis form chromium cast iron having properties substantially different from the properties of the base casting alloy.

The results of experimental studies indicate two important parameters influencing the course of hardness changes. The first is the effect of moderator, which by stabilizing the reactive infiltration process controls the dimensional stability of composite zones. The dimensional stability ensures the maximum volume fraction of carbides in the zone at a given content of the reactants of the formation of these carbides, and hardness of the composite zone corresponding to this fraction. In addition to the volume fraction of the obtained carbides, of some importance is also their morphology and interconnections between the bridges formed. As can be seen in FIGS. 11-14, the highest hardness is obtained in the zones reinforced with TiC carbide, when the moderator content is 60-70 wt % of the powder composition used for the fabrication of casting insert. This range of the moderator percent content in the composite zone is optimal for moderators in the form of pure iron powders, a powder mixture having the composition of chromium cast iron, a powder mixture having the composition of cast Hadfield high-manganese steel with 21% Mn and a powder mixture having the composition of Ni-Hard4 chromium cast iron containing Ni. The moderator having the composition of Ni-Hard4 chromium cast iron (70 wt %) was chosen as an optimal one to increase the hardness of composite zones fabricated in a relatively soft cast L450 steel. The resulting high value of hardness (1400HV1, FIG. 13) was due to a synergy between moderator powders used in an amount of 70 wt % to produce phases typical of Ni-Hard4 chromium cast iron and reactants of the formation of titanium carbide TiC.

In a similar way, the moderator having the composition of cast manganese steel (FIG. 14) added in an amount of 70 wt % produces high hardness values in the composite zone (1200HV1) at a relatively low hardness of the base cast L450 steel (550HV1).

Optionally, the moderator composition may be supplemented with ceramic phases such as aluminium oxide $Al_2O_3$ or zirconium oxide $ZrO_2$, including its stabilized varieties. The introduction of ceramic phases to the composite zones can increase, through limited infiltration, the percent content of the reactants of the formation of titanium carbide and thus significantly improve the resistance to abrasion. The ceramic phases in the form of oxides introduced by themselves can also increase the wear resistance of the composite zones and are less expensive than, for example, titanium Ti used for the formation of TiC carbide. In this particular case, the high percent content of the reactants of the formation of titanium carbide TiC does not result in the composite zone fragmentation, since ceramic phases, especially aluminium oxide, by having a high specific heat, absorb the heat formed during the SHS synthesis, thus exerting control over the SHS process. The use of aluminium oxide $Al_2O_3$ or zirconium oxide $ZrO_2$ in the moderator composition produces composite zones characterized by very high resistance to abrasive wear, but practical use of such inserts is limited to those applications where high impact resistance is not required.

Figure 15:
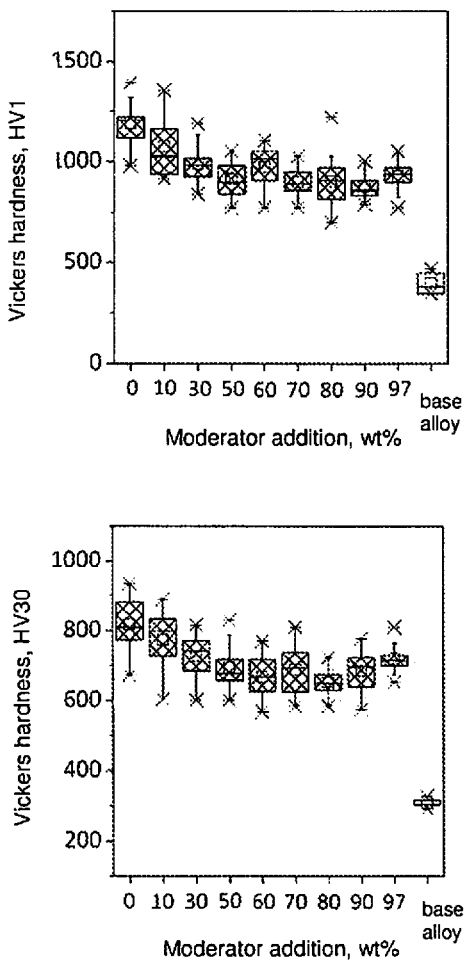
Figure 16:
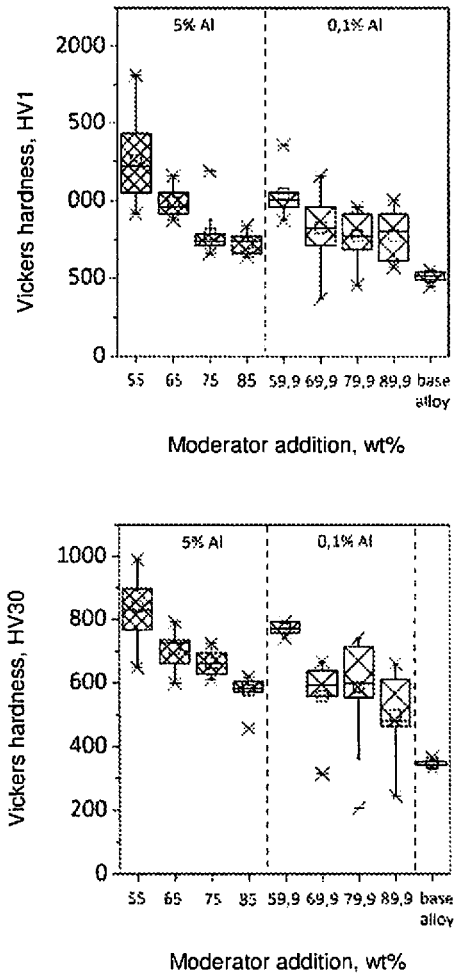

In the composite zones reinforced with WC carbide, the highest hardness shown in FIG. 15 is obtained with a low content of the moderator. In this particular case, however, hardness does not decrease with the increasing addition of the moderator. As a consequence, preferably, using the addition of moderator, it is possible to produce a reinforcement in the casting with a reduced amount of the expensive tungsten W. Composite zones reinforced with the (Ti, W)C carbide, formed as a result of the coupled reaction of synthesis, have preferable hardness values shown in FIG. 16 at a 55% level of the moderator addition.

In addition to the results of hardness measurements obtained for individual composite zones and shown in FIGS. 11-14, Table 9 compares the results of abrasion resistance testing carried out in selected composite zones. The measurements of the wear index of the composite zones and of the cast L35GSM steel were taken by a Ball-on-Disc method according to ISO 20808: 2004. The test results disclosed in the table below confirm that the composite zones with high hardness are characterized by a low wear index. For example, the composite zone based on a matrix made from the Ni-Hard4 chromium cast iron has the hardness of 1400HV1 and, at the same time, the lowest wear index of $7.07*10^{-6}$ [$mm^3/Nm$].

TABLE 9

| Description of composite zone | Chemical composition of moderator wt % | Moderator content wt % | Reactants of TiC formation wt % | Disc wear index, W * $10^{-6}$ [$mm^3/N * m$] |
|---|---|---|---|---|
| Composite zone based on Ni-Hard4 chromium cast iron | 3.6-C; 2.2-Si; 0.8-Mn; 5.5-Ni; 10-Cr; 0.5-Mo; Fe-rest; | 70 | 30 | 7.07 |

TABLE 9-continued

| Description of composite zone | Chemical composition of moderator wt % | Moderator content wt % | Reactants of TiC formation wt % | Disc wear index, W * $10^{-6}$ [$mm^3$/N * m] |
|---|---|---|---|---|
| Composite zone based on cast Hadfield steel | 12-Mn; 0.4-Si; 0.32-C; Fe-rest | 70 | 30 | 14.11 |
| Composite zone based on cast Hadfield steel with the addition of Al2O3 and ZrO2—Y2O3 moderators | 70% (12-Mn; 0.4-Si; 0.32-C; Fe-rest); 15% (Al2O3-7.5; ZrO2—Y2O3-7.5) | 85 | 15 | 17.80 |
| Composite zone based on high-chromium cast iron | 3.31-C; 0.87-Si; 0.69-Mn; 26.6-Cr; Fe rest | 70 | 30 | 21.95 |
| Composite zone based on pure iron | 100-Fe | 70 | 30 | 137.23 |
| Cast L35GSM steel | — | — | — | 860 |

The method for producing local composite zones in castings according to the present invention is illustrated in FIG. 11 and described in Examples 4-7.

Example 4

Composite casting for use in an environment of high abrasive wear and low dynamic loads. A mixture of titanium powders with the average diameter of less than 44.5 μm and carbon powders with the average diameter of less than 3 μm was prepared, maintaining the mutual atomic ratio of 1:1. To 40 wt % of the powder mixture of reactants of the formation of titanium carbide TiC, the addition of 59 wt % of a moderator was introduced, said moderator being a powder mixture having the composition of Ni-Hard4 chromium cast iron comprising Fe, Cr, Ni, Mn, Si, Mo and C, some of which were introduced in the form of ferroalloys. Additionally, to the powder mixture, the addition of 1 wt % of a reducing component in the form of Al powder was introduced. Then all the powders were mixed, dried and compressed under a pressure of 500 MPa. Thirty four casting inserts of 10×20×100 mm dimensions were obtained, and said casting inserts were fixed by means of assembly tools in the mould cavity in the area of the estimated highest wear occurring in a 17 kg weighing casting. To remove moisture, mould with the fixed set of casting inserts was dried with a gas burner. Said mould was next poured with molten casting alloy having the composition of chromium cast iron. As a result, a casting was obtained, reinforced with the composite zones containing mainly submicron oval particles of the TiC carbide disposed in an austenitic matrix and containing also particles of the $Cr_7C_3$ carbide.

Example 5

Composite casting for use in an environment of high abrasive wear and high dynamic loads. A mixture of titanium powders with the average diameter of less than 44.5 μm and carbon powders with the average diameter of less than 3 μm was prepared, maintaining the mutual atomic ratio of 1:1. To 30 wt % of the powder mixture of reactants of the formation of titanium carbide TiC, the addition of 69 wt % of a moderator was introduced, said moderator being a powder mixture having the composition of cast high-manganese steel with 21 wt % Mn comprising Fe, Mn, Si, C, some of which were introduced in the form of ferroalloys, introducing also minor additions of other elements. Additionally, to the powder mixture, the addition of 1 wt % of a reducing component in the form of Al powder was introduced. The reducing component was introduced in order to bind the gases present in the compact. Then all the powders were mixed, dried and compressed under a pressure of 500 MPa. The obtained casting inserts of 15×20×100 mm dimensions produced in an amount of 100 pieces were placed in the area of the estimated highest wear occurring in a 200 kg weighing casting. To remove moisture, mould with the fixed set of casting inserts was dried with a gas burner. Said mould was next poured with molten casting alloy having the composition of manganese steel containing 18 wt % Mn. As a result, a casting was obtained, reinforced with the composite zones containing mainly submicron particles of the TiC carbide disposed in an austenitic matrix.

Example 6

Ultra-high abrasive wear resistant casting for use in an environment free from high dynamic loads. A mixture of titanium powders with the average diameter of less than 44.5 μm and carbon powders with the average diameter of less than 3 μm was prepared, maintaining the mutual atomic ratio of 1:1. To 50 wt % of the powder mixture of reactants of the formation of TiC carbide, the addition of the following moderators was introduced: 10 wt % of $ZrO_2$—$Y_2O_3$, 10 wt % of $Al_2O_3$ and 29 wt % of a powder mixture having the composition of cast high-manganese steel containing 21 wt % Mn. Additionally, to the powder mixture, the addition of 1 wt % of a reducing component in the form of Al powder was introduced in order to bind the gases present in the compact. Then all the powders were mixed, dried and compressed under a pressure of 500 MPa. As a result, casting inserts of 10×20×100 mm dimensions were obtained and were next fixed by means of assembly tools in the mould cavity. To remove moisture, mould with the fixed set of casting inserts was dried with a gas burner. Said mould was next poured with molten casting alloy having the composition of high-manganese steel containing 18 wt % Mn. As a result, a 40 kg weighing casting was obtained, reinforced with the zones comprising a hybrid composite of the TiC/$Al_2O_3$/$ZrO_2$-$Y_2O_3$/matrix type, consisting mainly of submicron and micron particles of the TiC carbide, and of micron and millimeter particles of the $Al_2O_3$ and $ZrO_2$—$Y_2O_3$ oxides.

Example 7

Ultra-high abrasive wear resistant casting for use in an environment free from high dynamic loads. A mixture of titanium powders with the average diameter of less than 44.5 μm and carbon powders with the average diameter of less than 3 μm was prepared, maintaining the mutual atomic ratio of 1:1. To 30 wt % of the powder mixture of reactants of the formation of titanium carbide TiC, the addition of 39 wt % of a moderator was introduced, said moderator being a powder mixture having the composition of cast high-manganese steel containing 21% Mn, said mixture comprising Fe, Mn, Si, C, some of which were introduced in the form of ferroalloys, introducing also minor additions of other elements with the average diameter of less than 44.5 μm, and 30 wt % of a ceramic moderator in the form of $Y_2O_3$-stabilized $ZrO_2$ powder with the average diameter of less than 1 mm Additionally, to the powder mixture, 1 wt % of a reducing component in the form of Al powder was introduced. The reducing component was introduced in order to bind the gases present in the compact. Then all the powders were mixed, dried and compressed under a pressure of 500 MPa.

Example 8A

Casting inserts of 15×20×100 mm dimensions based on the powder mixture according to Example 7 were produced and in an amount of 5 pieces were next fixed in a 7 kg weighing casting in the area of the expected highest wear. To remove absorbed moisture, mould with the set of casting inserts fixed inside was dried with a gas burner. Said mould was next poured with molten casting alloy having the composition of L35GSM steel. As a result, a casting was obtained, reinforced with the zones comprising a hybrid composite of the TiC/$ZrO_2$-$Y_2O_3$/matrix type consisting mainly of submicron and micron particles of the TiC carbide, and of micron and millimeter particles of the $ZrO_2$—$Y_2O_3$ oxide.

Example 8b

Casting insert in a first variant of the second embodiment. A mixture of titanium powders with the average diameter of less than 44.5 μm and carbon powders with the average diameter of less than 3 μm was prepared, maintaining the mutual atomic ratio of 1:1. To 45 wt % of the powder mixture of reactants of the formation of titanium carbide TiC, the addition of 10 wt % of a moderator was introduced, said moderator being a powder mixture having the composition of chromium cast iron comprising Fe, Cr, Mn, Mo, Si, C, some of which were introduced in the form of ferroalloys, introducing also minor additions of other elements with the average diameter of less than 44.5 μm, and the addition of 45 wt % of a ceramic moderator composed in 5 wt % of the $Y_2O_3$-stabilized $ZrO_2$ powder with the average diameter of less than 100 μm and in 40 wt % of the $Al_2O_3$ powder with the average diameter of less than 130 μm. Additionally, to the powder mixture, 1 wt % of a reducing component in the form of Al powder was introduced. Then all the powders were mixed, dried and compressed under a pressure of 500 MPa to form casting inserts of 15×20×100 mm dimensions.

Example 8c

Casting insert in a second variant of the second embodiment. A mixture of titanium powders with the average diameter of less than 44.5 μm and carbon powders with the average diameter of less than 3 μm was prepared, maintaining the mutual atomic ratio of 1:1. To 20 wt % of the powder mixture of reactants of the formation of titanium carbide TiC, the addition of 19 wt % of a moderator was introduced, said moderator being a powder mixture having the composition of chromium cast iron comprising Fe, Cr, Mn, Si, C, some of which were introduced in the form of ferroalloys, and the addition of 60 wt % of a ceramic moderator composed of the $Y_2O_3$-stabilized $ZrO_2$ powder with the average diameter of less than 0.5 mm Additionally, to the powder mixture, 1 wt % of a reducing component in the form of Al powder was introduced. Then all the powders were mixed, dried and compressed under a pressure of 500 MPa to produce casting inserts of 15×20×100 mm dimensions.

Local composite zones are produced by placing casting inserts in the mould cavity, said inserts being obtained by compacting a powder mixture comprising the reactants of the formation of carbides undergoing the SHS synthesis, for example TiC carbides, and a mixture of selected powders of metals and non-metals, which after casting solidification form a composite matrix, said matrix being a casting iron-based alloy. The moderator introduced in an amount of from 60 to 97 wt % stabilizes the geometric dimensions of the composite zones and prevents fragmentation of said zones in the course of reactive infiltration that takes place during the synthesis of titanium carbide TiC in castings with the wall thickness of from 10 to 150 mm. The minimum amount of the reactants of the formation of titanium carbide TiC providing the in situ formation of a composite matrix is 3 wt %. Reducing the amount of the reactants of the formation of titanium carbide TiC is not effective and does not lead to the formation of designed structure of the composite matrix in the composite zone. The use of ceramic structures based on aluminium oxide and zirconium oxide can increase the percent content of TiC crystals (>30%) in the composite zone, thereby producing a significant increase in both hardness and abrasion resistance.

For the synthesis of composite zones reinforced with WC carbide, the moderator may be used in amounts of up to 60 wt %, as above this level the reaction is inefficient and suppressed. Using the reactants of WC carbide formation with the addition of moderator in an amount of up to 60 wt % it is possible to obtain dimensionally stable composite zones, as illustrated in FIG. 5.

It is also possible to produce the composite zones according to the present invention using mixtures of the reactants of the formation of, for example, TiC carbide and WC carbide, as depicted in FIG. 6. Then, as a result of the coupled reaction of synthesis proceeding in the casting, carbides of the (W, Ti) C or (Ti, W)C type with a core-ring structure are formed. Owing to the coupled reaction of synthesis, it is possible to use a higher content of the moderator and control the mechanical properties of the composite zone.

The powder compositions and casting inserts for the in situ fabrication of composite zones in castings according to the present invention allow an extensive use of different types of carbides and borides undergoing the reaction of the SHS synthesis. Examples of the fabrication of composite zones in castings comprise two extreme cases of the use of carbides and mixtures thereof; these are the TiC and WC carbides, and a (W, Ti) C carbide, respectively.

The invention claimed is:

1. A casting insert for fabrication of local composite zones resistant to wear, comprising reactants of carbide formation, wherein said insert in the form of shapes, solids, preforms or granules comprises a compacted composition of powders, said composition of powders comprises:

powder reactants of formation of carbides or borides selected from the group of TiC, WC, ZrC, NbC, TaC, $TiB_2$, $ZrB_2$, or mixtures thereof, wherein said carbides or borides after crystallization form particles reinforcing composite zones in castings, and moderator powders forming a mixture of metal powders, wherein said metal powders after crystallization form a matrix of a composite zone in a casting, wherein an amount of powder reactants of a formation of TiC carbide is from 3 to 40 wt % and an amount of moderator powders is from 60 to 97 wt %;

an amount of powder reactants of a formation of WC carbide is from 40 to 99 wt % and an amount of moderator powders is from 1 to 60 wt %; and an amount of mixture of powders of the reactants of a coupled reaction of a synthesis of TiC and WC carbides is from 10 to 70 wt % and an amount of moderator powders is from 30 to 90 wt %.

2. The casting insert according to claim 1, wherein the powders of the reactants of a formation of carbides have particles of a size of up to 100 μm.

3. The casting insert according to claim 1, wherein carbon as a powder reactant is in a form of graphite, amorphous graphite, a carbonaceous material or a mixture thereof, and in a case of Ti, W, Zr, Nb, Ta these are the powders of pure metals or alloys of said metals with other elements, or mixtures thereof.

4. The casting insert according to claim 1, wherein the moderator powders additionally comprise a non-metal in a form of carbon.

5. The casting insert according to claim 1, wherein the moderator powders from the group of metals comprise any powder selected from the group of Fe, Co, Ni, Mo, Cr, W, Al, or comprise a mixture of said powders.

6. The casting insert according to claim 1, wherein the moderator powders further comprise at least one powder selected from the group of Mn, Si, Cu, B, or a mixture of said powders.

7. The casting insert according to claim 1, wherein the moderator powders have a chemical composition of an alloy selected from the group of grey cast iron, white cast iron, chromium cast iron, cast chromium steel, cast unalloyed steel, cast low-alloy steel, cast Hadfield manganese steel, or Ni-Hard4 chromium cast iron containing Ni.

8. The casting insert according to claim 1, wherein the moderator powder is a mixture of powders selected from the group of (a) Fe, Cr, Mn, Si, Mo, C; (b) Fe, Cr, Mn, Si, C; (c) Co, Cr, W, C; (d) Co, Fe, Ni, Mo, Cr, C; (e)Ni, Cr, Mo, Nb, Al, Ti, Fe, Mn, Si; (f) Ni, Cr, Co, W, Nb, Al, Ti, C, B, Zr; (g) Co, Ni, Fe.

9. The casting insert according to claim 1, wherein the moderator powders also include phases of ceramic powders increasing resistance to wear, the phases of ceramic powders selected from the group of $ZrO_2$, stabilized $ZrO_2$, $Al_2O_3$ or a mixture thereof; and/or a reducing component in a form of Al and/or Si, wherein an amount of the reducing component is maximum 5 wt % of the powder composition.

* * * * *